US008276422B2

(12) United States Patent
Berendes

(10) Patent No.: US 8,276,422 B2
(45) Date of Patent: Oct. 2, 2012

(54) ROLLER DEVICE

(75) Inventor: Andreas Berendes, Kirchhundem (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 547 days.

(21) Appl. No.: 12/448,798

(22) PCT Filed: Feb. 14, 2008

(86) PCT No.: PCT/EP2008/001102

§ 371 (c)(1),
(2), (4) Date: Jul. 8, 2009

(87) PCT Pub. No.: WO2008/110243

PCT Pub. Date: Sep. 18, 2008

(65) Prior Publication Data

US 2010/0024506 A1 Feb. 4, 2010

(30) Foreign Application Priority Data

Mar. 15, 2007 (DE) ..... 10 2007 012 430
Sep. 8, 2007 (DE) ..... 10 2007 042 896

(51) Int. Cl.
*B21B 31/18* (2006.01)
*B21B 31/16* (2006.01)

(52) U.S. Cl. ..... 72/247; 72/241.8

(58) Field of Classification Search ..... 72/237, 72/245, 247, 241.6, 241.8
See application file for complete search history.

(56) References Cited

U.S. PATENT DOCUMENTS 4,785,651 A * 11/1988 Kuhn ..... 72/247
5,782,127 A * 7/1998 Donini et al. ..... 72/247
5,870,920 A * 2/1999 Drigani et al. ..... 72/247
5,924,319 A * 7/1999 Ginzburg ..... 72/247
6,976,379 B2 * 12/2005 Drigani et al. ..... 72/241.8
7,021,104 B2 * 4/2006 Drigani et al. ..... 72/237
7,299,673 B2 * 11/2007 Zieser et al. ..... 72/247
7,895,871 B2 * 3/2011 Zieser et al. ..... 72/245

FOREIGN PATENT DOCUMENTS

| | | |
|---|---|---|
| DE | 1 427 950 | 11/1968 |
| DE | 24 40 495 | 3/1975 |
| DE | 36 03 693 | 8/1987 |
| DE | 37 22 054 | 1/1989 |
| DE | 38 07 628 | 9/1989 |

(Continued)

*Primary Examiner* — Dana Ross
*Assistant Examiner* — Pradeep C Battula
(74) *Attorney, Agent, or Firm* — Lucas & Mercanti, LLP; Klaus P. Stoffel

(57) ABSTRACT

The invention pertains to a rolling device (1) with at least two rolls that are respectively supported in a roll stand (3) by means of chocks (2), wherein the rolls are provided with axial displacement means (4) that serve for the axial displacement in a displacing direction (x) and make it possible to move the rolls into a desired position relative to the roll stand (3), as well as to hold the rolls in this position, and wherein the rolls are functionally connected to bending means (5) that make it possible to subject the rolls to a bending moment. In order to maintain the bending force losses caused by the weight of the axial displacement means at a minimum, the invention proposes that a first functional end (6) of the axial displacement means (4) is arranged on the roll stand (3) directly or indirectly by means of an articulated connection (7) and a second functional end (8) of the axial displacement means is arranged on the chock (2) by means of an articulated connection (9).

8 Claims, 2 Drawing Sheets

FOREIGN PATENT DOCUMENTS

Figure 1:
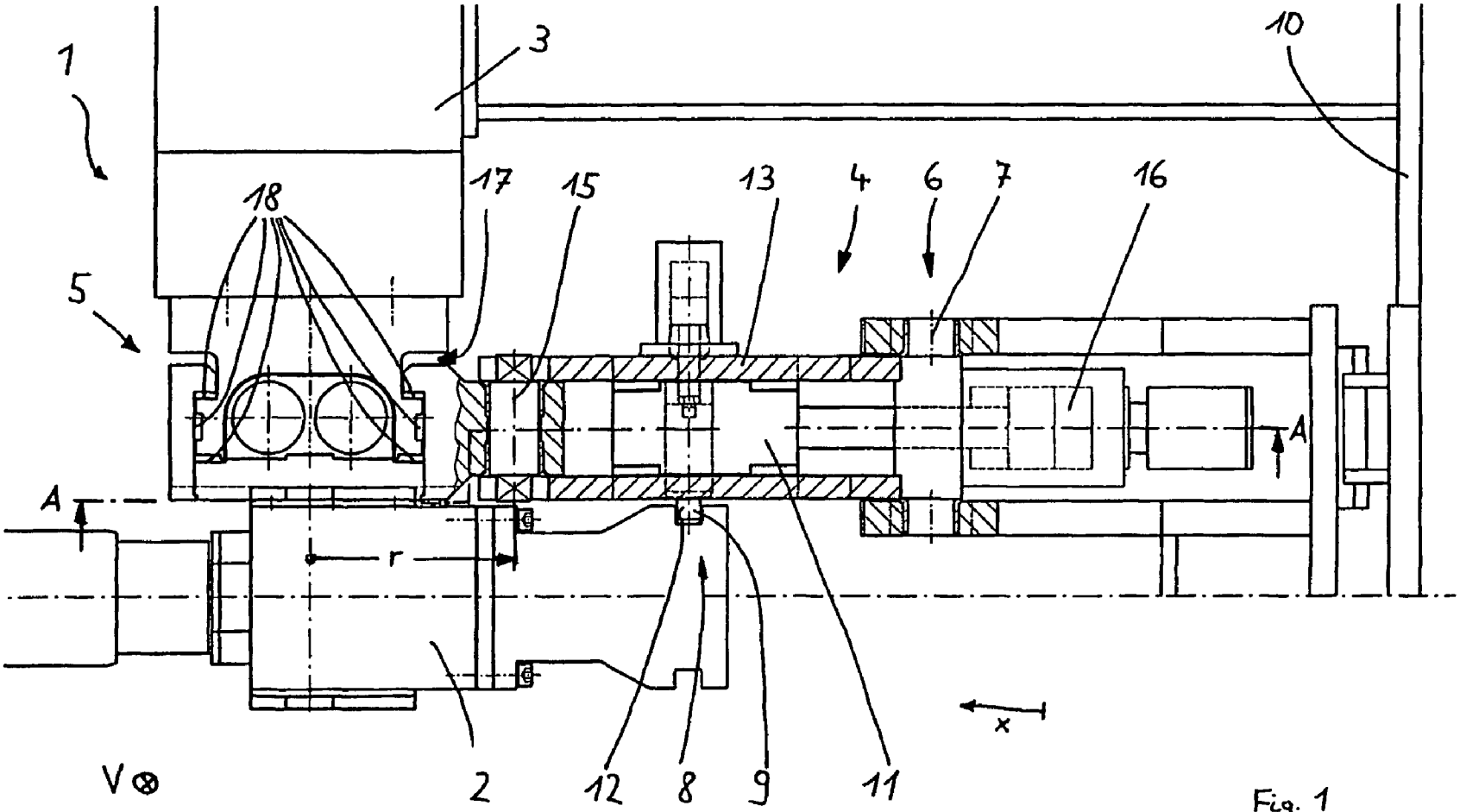

| | | | |
|---|---|---|---|
| EP | 0 326 805 | | 8/1989 |
| EP | 0 354 170 | | 2/1990 |
| WO | 98/26883 | | 6/1998 |
| WO | 2005/011884 | | 7/2004 |
| WO | WO2005/011884 | * | 2/2005 |
| WO | WO/2005/011885 | * | 2/2005 |

* cited by examiner

ROLLER DEVICE

The invention pertains to a rolling device with at least two rolls that are respectively supported in a roll stand by means of chocks, wherein the rolls are provided with axial displacement means that serve for the axial displacement in a displacing direction and make it possible to move the rolls into a desired position relative to the roll stand, as well as to hold the rolls in this position, and wherein the rolls are functionally connected to bending means that make it possible to subject the rolls to a bending moment.

A rolling device of this type is known, for example, from WO 2005/011884 A1, wherein two working rolls that are spaced apart from one another by a defined distance form the roll gap required for the rolling process, and wherein the working rolls can be supported on backup rolls or intermediate rolls. A thusly designed rolling device therefore may be respectively equipped with four or six rolls, wherein the individual rolls can be positioned relative to one another in the vertical direction in order to realize the desired roll gap.

In this case, the working rolls are arranged in an axially displaceable fashion such that it is possible to influence the strip profile in strip rolling mills by means of a variable roll gap profile. The procedural option of an axial displacement of the working rolls is also important in blooming trains, namely not only for purposefully influencing the strip profile, but also for extending the roll campaign by means of purposeful wear distribution.

Another important aspect of the rolling device described in WO 2005/011884 A1 can be seen in that means for bending or balancing the working rolls are provided. These bending means make it possible to introduce a bending moment into the working rolls such that procedural advantages are achieved.

The bending and displacing systems for the working rolls are accommodated in stationary blocks, in which the adjusting means required for the bending and balancing or the axial displacement are arranged. They provide the advantage of fixed pressure medium supply lines that do not have to be disconnected when the working roll is exchanged. In order to realize the bending and balancing, the required rams are either arranged in stationary blocks, in which case it is disadvantageous that significant tilting moments occur during the axial displacement, or they are realized in the form of cassettes that participate in the axial displacement in order to better manage the tilting moments and the frictional forces.

Other solutions of this type which are realized similar to WO 2005/011884 A1 are described in EP 0 326 805 B1, DE 24 40 495 A1, DE 36 03 693 A1, WO 98/26883 A1 and DE 38 07 628 C2.

In instances in which the bending device and the axial displacement device consist of a combined mechanical unit, in which the displacement device is realized in the form of a cantilever on the guide blocks of the bending device, all known solutions have the disadvantage that a torque is generated due to the own weight of the displacement device, wherein this torque needs to be absorbed by the vertically standing guides of the bending device. This results in a frictional force in the guides of the bending device which negatively influences the control response.

The negative influence of this frictional force increases as the height of the vertical guides of the bending device decreases. The height of the guides is directly correlated to the roll diameter, i.e., the negative influence of the frictional force being generated is greater with small roll diameters than with large roll diameters.

The invention therefore is based on the objective of additionally developing a rolling device of the initially cited type in such a way that the aforementioned disadvantages are eliminated or at least diminished, i.e., that the influences with respect to the frictional forces acting upon the guides of the bending means, in particular, due to the own weight of the axial displacement means are diminished.

According to the invention, this objective is attained in that a first functional end of the axial displacement means is arranged on the roll stand directly or indirectly by means of an articulated connection and a second functional end is arranged on the chock by means of an articulated connection.

In this case, the axial displacement means are preferably arranged on the roll stand indirectly by means of a connecting frame. Their second functional end may be accommodated in a locking block that is arranged in or on the bending means such that it is movable in the displacing direction of the axial displacement means. In this case, one additional development proposes that a positive connection between the locking block and the chock which is effective in the displacing direction of the axial displacement means is produced by means of an articulated connection in the form of a connecting bolt. For this purpose, at least one recess that is realized congruent to the shape of the locking bolt may be arranged in the chock. Furthermore, the locking block may be supported in or on the bending means with the aid of a guide at a location that is spaced apart from the first functional end. In this case, the guide preferably features a connecting link, in which a bolt connected to the bending means is arranged. The connecting link is advantageously realized in the form of a groove-shaped recess extending in the displacing direction of the axial displacement means.

The axial displacement means preferably feature a hydraulic piston-cylinder system.

The first and/or second functional end of the axial displacement means may be displaceably arranged on the axial displacement means and/or on the guide. This makes it possible to easily realize an adaptation of the coupling points if an additional roll displacement occurs in the horizontal rolling direction.

The proposed measures principally minimize a torque being generated in the guides of the bending device irrespective of the roll diameter and the available structural height. The aforementioned disadvantageous consequences are diminished in this fashion. It is possible, in particular, to improve the control response of the bending device.

Consequently, a system-related minimization of the bending force losses due to internal friction takes place.

One embodiment of the invention is illustrated in the figures.

The figure show:

FIG. 1, a detail of a rolling device in the form of a top view, and

Figure 2:
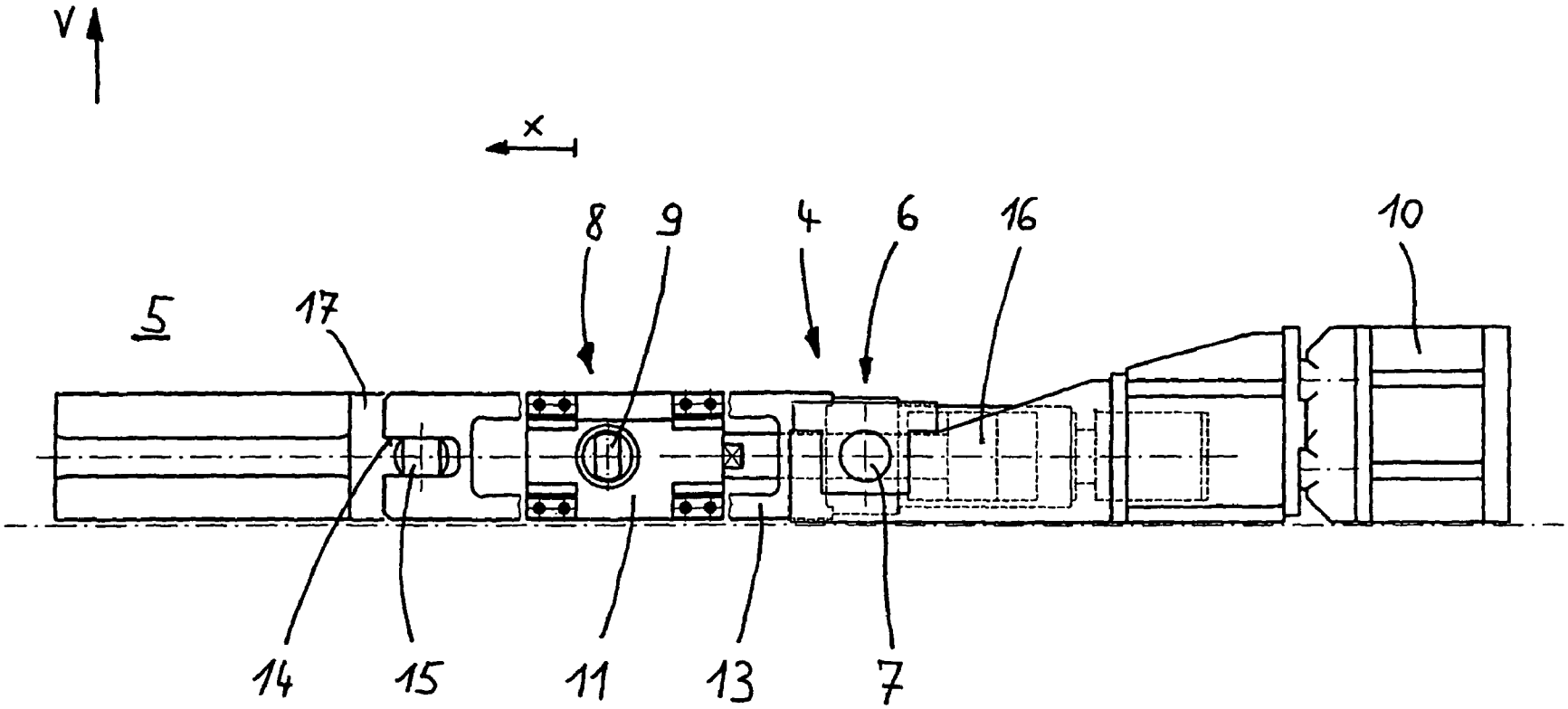

FIG. 2, a section along the line A-A in FIG. 1, in which the bending means are not illustrated.

The figures show a—only very partial—illustration of a rolling device 1 of conventional design. In this respect, we refer to WO 2005/011884 A1 that contains more detailed information on such a rolling device.

Two not-shown working rolls are held by chocks 2, one of which is illustrated in FIG. 1. The chocks 2 are supported in a roll stand (or roll housing) 3. In this case, however, provisions are made for axially displacing the working rolls in a displacing direction x and for subjecting the working rolls to a bending moment. Generally known axial displacement means 4 and bending means 5 are provided for this purpose.

The axial displacement means 4 feature a hydraulic piston-cylinder system 16 in order to generate a force. The axial displacement means 4 have two functional ends 6 and 8, between which they are able to generate their displacement force in the displacing direction x. The first functional end 6 is situated on the right side in the figures and fixed on a connecting frame 10 by means of an articulated connection 7 in the form of a bolt, wherein said connecting frame is mounted on the roll stand 3. The axial displacement means 4 are also coupled in an articulated fashion on a second functional end 8 that is situated farther to the left in the figures, namely by means of an articulated connection 9 in the form of a locking bolt.

The locking bolt 9 is supported in a locking block 11 such that the locking block 11 is also displaced during a displacement of the axial displacement means 4. The locking bolt 9 extends through the locking block 11 (see FIG. 1) and engages into a recess 12 in the chock 2. Due to these measures, a displacement of the axial displacement means 4 is transmitted to the chock 2 and therefore to the roll via the locking block 11; the roll is then axially displaced in the displacing direction x.

FIG. 2, in particular, shows that a recess 17 is arranged in the bending means 5, wherein the locking block 11 is accommodated in said recess and movable in the displacing direction x. One end (the left end in the figures) of a guide 13 accommodated in the recess 17 is supported by means of a connecting link 14 and a bolt 15 that is secured in the bending means 5. The connecting link 14 is realized in the form of a groove that extends in the displacing direction x—as shown in FIG. 2. The bolt 15 supports one end of the guide 13.

When the bending means 5 move upward and downward in the vertical direction V on vertical guides 18 (see FIG. 1), they are only subjected to part of the weight of the axial displacement means 4, namely with a relatively short lever arm r (see FIG. 1). This means that the weight of the axial displacement means 4 can only cause a very low torque to be generated in the vertical guides 18 of the bending device 5, wherein this is also ensured in that the effective weight is balanced in the journal due to the support.

The most important functions can be summarized as follows: one can easily recognize that the bending means 5 and the axial displacement means 4 are arranged separately of one another. The bending means remain largely unchanged—in comparison to known solutions—with respect to their function and the mechanical design of the components. The locking block 11 travels in the guides 13 that form an extension of the piston-cylinder system 16. The chocks 2 are coupled to the axial displacement means 4 by means of the locking block 11. The guides 13 are supported on the bending means 5 by the bolt 15 that travels in the connecting link 14.

Provisions may be made for a corresponding displacement of the link pivot points in order to make it possible to utilize the device when the rolls are also horizontally displaced in the rolling direction.

LIST OF REFERENCE SYMBOLS

1 Rolling device
2 Chock
3 Roll stand (roll housing)
4 Axial displacement means
5 Bending means
6 First functional end
7 Articulated connection
8 Second functional end
9 Articulated connection (locking bolt)
10 Connecting frame
11 Locking block
12 Recess
13 Guide
14 Connecting link
15 Bolt
16 Hydraulic piston-cylinder system
17 Recess in bending means
18 Vertical guides
x Displacing direction
V Vertical line
r Lever arm

The invention claimed is:

1. A rolling device (1) with at least two rolls that are respectively supported in a roll stand (3) by means of chocks (2), wherein the rolls are provided with axial displacement means (4) that serve for the axial displacement in a displacing direction (x) and make it possible to move the rolls into a desired position relative to the roll stand (3), as well as to hold the rolls in this position, and wherein the rolls are functionally connected to bending means (5) that make it possible to subject the rolls to a bending moment wherein a first functional end (6) of the axial displacement means (4) is arranged on the roll stand (3) directly or indirectly by means of an articulated connection (7) and a second functional end (8) of the axial displacement means is arranged on the chock (2) by means of an articulated connection (9), wherein the second functional end (8) of the axial displacement means is arranged in a locking block (11) that is arranged in or on the bending means (5) such that it is movable in a displacing direction (x) of the axial displacement means (4), wherein a positive connection between the locking block (11) and the chock (2) which is effective in the displacing direction (x) of the axial displacement means (4) consists of an articulated connection (9) in the form of a locking bolt.

2. The rolling device according to claim 1, wherein the axial displacement means (4) are arranged on the roll stand (3) indirectly by means of a connecting frame (10).

3. The rolling device according to claim 1, wherein the chock (2) contains at least one recess (12) that is realized congruent to the shape of the locking bolt (9).

4. The rolling device according to claim 1, wherein the locking block (11) is supported in or on the bending means (5) by means of a guide (13), namely at a location that is spaced apart from the first functional end (6).

5. The rolling device according to claim 4, wherein the guide (13) features a connecting link (14), in which a bolt (15) connected to the bending means (5) is arranged.

6. The rolling device according to claim 5, wherein the connecting link (14) is realized in the form of a groove-shaped recess extending in the displacing direction (x) of the axial displacement means (4).

7. The rolling device according to claim 4, wherein the first and/or second functional end (6, 8) of the axial displacement means (4) is/are displaceably arranged on the axial displacement means (4) and/or on the guide (13).

8. The rolling device according to claim 1, wherein the axial displacement means (4) feature a hydraulic piston-cylinder system (16).

* * * * *